US011852059B2

(12) United States Patent
Jasteh et al.

(10) Patent No.: US 11,852,059 B2
(45) Date of Patent: *Dec. 26, 2023

(54) NOISE MUFFLER FOR AN AIR MOVING DEVICE

(71) Applicant: Rheem Manufacturing Company, Atlanta, GA (US)

(72) Inventors: Sina Jasteh, Montgomery, AL (US); William Simard, West Sand Lake, NY (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/871,719

(22) Filed: Jul. 22, 2022

(65) Prior Publication Data

US 2023/0041732 A1 Feb. 9, 2023

Related U.S. Application Data

(63) Continuation of application No. 16/725,648, filed on Dec. 23, 2019, now Pat. No. 11,415,032.

(51) Int. Cl.

| | |
|---|---|
| ***F24F 13/24*** | (2006.01) |
| ***F04D 29/66*** | (2006.01) |
| ***G10K 11/16*** | (2006.01) |
| ***F01N 1/24*** | (2006.01) |

(52) U.S. Cl.

CPC ..... *F01N 1/24* (2013.01); *F24F 13/24* (2013.01); *F24F 2013/242* (2013.01)

(58) Field of Classification Search

CPC ... F01N 1/24; F01N 1/10; F01N 1/083; F01N 1/125; F24F 13/24; F24F 2013/242; F04D 29/663; F04D 29/664; G10K 11/16; G10K 11/161; G10K 11/162

See application file for complete search history.

(56) References Cited

U.S. PATENT DOCUMENTS

| | | | |
|---|---|---|---|
| 1,246,196 | A | 11/1917 | Weisberg |
| 1,280,386 | A | 10/1918 | Buehner |
| 2,853,147 | A | 9/1958 | D'Eustachio |
| 3,495,950 | A | 2/1970 | Barber et al. |
| 3,981,378 | A | 9/1976 | Potter |
| 4,126,205 | A | 11/1978 | Bauerschmidt |
| 4,164,265 | A | 8/1979 | Kucharczyk |
| 4,165,798 | A | 8/1979 | Martinez |

(Continued)

FOREIGN PATENT DOCUMENTS

| | | | | |
|---|---|---|---|---|
| DE | 3151386 C2 * | 5/1987 | ..... | F04D 29/664 |
| DE | 4445286 A1 | 6/1996 | | |

(Continued)

*Primary Examiner* — Edgardo San Martin

(74) *Attorney, Agent, or Firm* — Eversheds Sutherland (US) LLP

(57) ABSTRACT

A noise muffler for an air moving device can include a housing with a housing inlet, a housing outlet, and at least a first foam component and a second foam component. The first foam component and the second foam component are placed within a cavity of the housing and define an air passageway. The first foam component and the second foam component redirect air flow through the cavity in three dimensions in order to muffle noise generated by the air moving device.

20 Claims, 5 Drawing Sheets

(56) References Cited

U.S. PATENT DOCUMENTS

| | | | | |
|---|---|---|---|---|
| 4,281,742 | A | 8/1981 | Scheuermann et al. | |
| 4,660,676 | A | 4/1987 | Eustace | |
| 4,786,299 | A | 11/1988 | DeMarco | |
| 5,046,977 | A | 9/1991 | Rodskier | |
| 5,266,753 | A | 11/1993 | Muschelknautz et al. | |
| 5,274,201 | A | 12/1993 | Steele | |
| 6,305,493 | B1 | 10/2001 | Laimböck | |
| 6,953,104 | B2 | 10/2005 | Monson et al. | |
| 7,165,647 | B2 | 1/2007 | Lee | |
| 7,549,505 | B1 | 6/2009 | Kawar | |
| 7,779,960 | B2 | 8/2010 | Tang et al. | |
| 10,240,535 | B2 | 3/2019 | Matsuyama et al. | |
| 10,309,302 | B2 | 6/2019 | Wilhelm et al. | |
| 10,928,096 | B2 * | 2/2021 | Hickey | F24F 13/24 |
| 11,415,032 | B2 * | 8/2022 | Jasteh | F01N 1/24 |
| 2002/0027041 | A1 | 3/2002 | Czabala et al. | |
| 2005/0051384 | A1 | 3/2005 | Breznik | |
| 2009/0133957 | A1 | 5/2009 | Owens | |

FOREIGN PATENT DOCUMENTS

| | | | | |
|---|---|---|---|---|
| DE | 102018003956 | | 11/2019 | |
| DE | 202021101036 | | 5/2021 | |
| EP | 3073208 | A1 * | 9/2016 | F24F 13/24 |
| EP | 3543622 | | 9/2019 | |
| JP | 2780840 | | 7/1998 | |
| WO | 2012169125 | A1 | 12/2012 | |

* cited by examiner

NOISE MUFFLER FOR AN AIR MOVING DEVICE

CROSS-REFERENCE TO RELATED APPLICATION

This application is a continuation of U.S. application Ser. No. 16/725,648, filed Dec. 23, 2019 and issued as U.S. Pat. No. 11,415,032, the entirety of which is hereby incorporated by reference.

TECHNICAL FIELD

Embodiments described herein relate generally to heat exchangers for heating devices, and more particularly to a noise muffler for a heat exchanger.

BACKGROUND

Heating and cooling appliances such as water heaters, HVAC systems, and furnaces typically include a heat exchanger and an air moving device such as a blower or fan that draws air into the appliance. The air moving device creates noise that emanates from the appliance. In most cases, an elbow or other tube is attached to the air moving device at the exterior of the appliance, however, the elbow or other tube does not reduce the noise emanating from the air moving device.

In view of these shortcomings, them is a need for an improvement to air moving devices that reduces the noise emanating from the air moving device.

SUMMARY

In general, in one aspect, the disclosure relates to a noise muffler for an air moving device. The noise muffler can be attached to a variety of types of appliances that have an air moving device such as a water heater or a heating, ventilation, and air conditioning system. The noise muffler comprises a housing, a housing inlet, and a housing outlet, wherein the housing defines a cavity within the housing. The noise muffler also comprises a first foam component located within the housing and a second foam component located within the housing. The first foam component and the second foam component are configured within the housing to redirect an air flow through the cavity in three dimensions.

In one example, the first foam component and the second foam component define an air channel through which the air flow passes. In one example, the entirety of the air channel can be surrounded by the foam of the first foam component, the second foam component, and a third foam component thereby optimizing the absorption of noise.

In an example embodiment, the first foam component can comprise a first opening and a second opening. The second foam component can comprise a third opening and a fourth opening. When the first foam component and second foam component are placed within the housing, an air flow can enter the housing inlet, follows a sequence of passing through the first opening, the third opening, the second opening, and then the fourth opening, and then exit through the housing outlet.

In another example embodiment, the first foam component can have a cross-section having a U shape and the second foam component has a wedge shape. When the first foam component and the second foam component are placed within the housing, an air flow can enter the housing inlet, pass around the first foam component and then be directed in a perpendicular direction by the second foam component, and then exit through the housing outlet.

These and other aspects, objects, features, and embodiments will be apparent from the following description and the appended claims.

BRIEF DESCRIPTION OF THE DRAWINGS

The drawings illustrate only example embodiments of a noise muffler for an air moving device. Therefore, the example embodiments of the drawings are not to be considered limiting in scope, as the example noise mufflers illustrated and described herein can be applied to a variety of appliances. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

Figure 1:
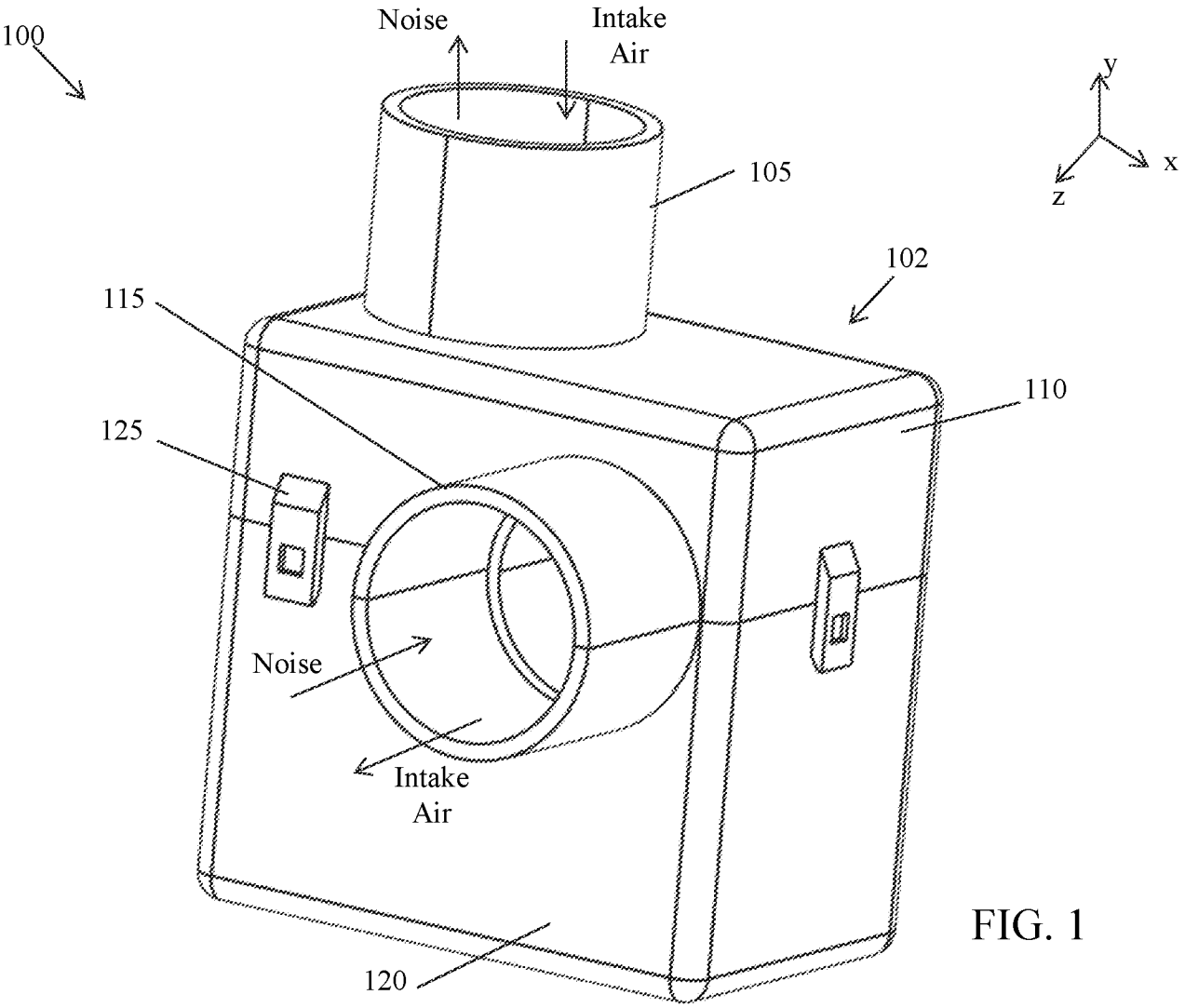
FIG. 1 illustrates an example a noise muffler for an air moving device in accordance with an example embodiment of the present disclosure.

The example embodiments discussed herein are directed to systems, methods, and devices for a noise muffler to be used with an air moving device. The noise muffler can attach to any of a variety of appliances that may contain an air moving device, such as a water heater, a furnace, an air conditioner, or an integrated heating, ventilation, and air conditioning system. While the noise muffler is referenced in the example embodiments described in connection with the drawings, it should be understood that the principles described herein can be applied to a variety of noise mufflers having different shapes or configurations. As described further below in connection with the example embodiments, the noise muffler can substantially reduce the level of noise emanating from an air moving device of an appliance.

In addition to reducing noise levels, the example noise mufflers described herein provide other advantages. First, the example noise mufflers are compact so that they can fit in small spaces to facilitate attachment to an appliance with an air moving device. Second, the example noise mufflers described herein provide a smooth air channel within the noise muffler so that the flow rate of air through the noise muffler is maintained at a sufficient level for operation of the appliance. Third, the example noise mufflers described herein are designed to simplify manufacturing and assembly of the noise mufflers.

Example embodiments of noise mufflers for air moving devices will be described more fully hereinafter with reference to the accompanying drawings, in which example embodiments of noise mufflers are shown. Noise mufflers may, however, be embodied in many different forms and should not be construed as limited to the example embodiments set forth herein. Rather, these example embodiments are provided so that this disclosure will be thorough and complete, and will fully convey the scope of the example noise mufflers to those of ordinary skill in the art. Like, but not necessarily the same, elements (also sometimes called components) in the various figures are denoted by like reference numerals for consistency.

Referring now to FIG. 1, an example noise muffler 100 is illustrated. The example noise muffler 100 comprises a housing 102, a housing inlet 105, and a housing outlet 115. The housing outlet 115 can be attached to an appliance comprising an air moving device. Typically, the appliance has an intake port through which air is drawn into the appliance by the air moving device and the housing outlet 115 of the noise muffler 100 can be attached to the intake port of the appliance. On the top side of the housing 102, the housing inlet 105 can be attached to a venting tube, such as a standard 2 inch PVC venting tube. As illustrated by the arrows in FIG. 1, the air moving device of the appliance draws intake air first through the housing inlet 105, then through the housing 102, and then through the housing outlet 115, where the intake air then enters the appliance.

As further illustrated by the arrows in FIG. 1, noise emanates from the air moving device of the appliance. When the noise muffler 100 is attached to the appliance, the noise emanating from the air moving device follows a path opposite to the intake air. In other words, noise from the air moving device first passes into the housing outlet 115, then through the housing 102, and then through the housing inlet 105. However, the features within the noise muffler 100 absorb a substantial portion of the noise thereby reducing the noise that passes into the environment surrounding the appliance to which the noise muffler is attached.

Figure 2:
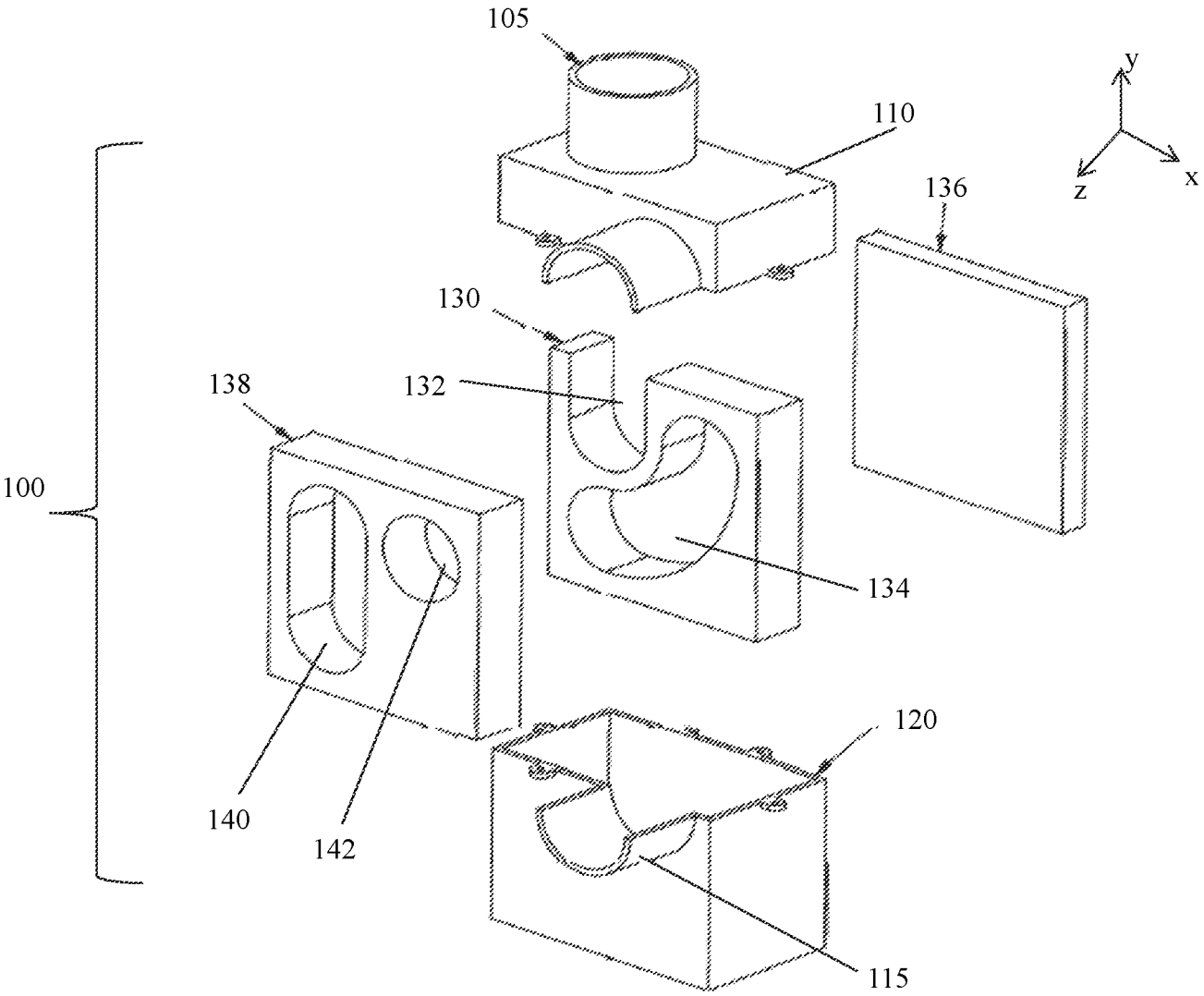
FIG. 2 illustrates an exploded view of the example noise muffler of FIG. 1 in accordance with an example embodiment of the present disclosure.

Referring now to FIG. 2, an exploded view of the example noise muffler 100 of FIG. 1 is shown. The snap features 125 shown in FIG. 1 can be disengaged to open the housing 102 of the noise muffler 100. In the example of the exploded view in FIG. 2, the snap features 125 have been replaced with bosses located on the exterior of the housing 102 and which can receive fasteners. The example housing 102 comprises a top portion 110 and a bottom portion 120. Within the example housing 102 are a first foam component 130, a second foam component 138, and a third foam component 136. In alternate embodiments of the noise muffler, greater or fewer foam components can be located within the housing 102. For example, any of the first, second, and third foam components could be split into smaller foam subcomponents. As another example, first foam component 130 and third foam component 136 could be combined into a single foam component so that only two foam components are located within the housing 102.

In the example shown in the exploded view of FIG. 2, the first foam component 130, the second foam component 138, and the third foam component 136 are located within the housing 102 so that one broad side of the first foam component 130 is adjacent one broad side of the second foam component 138 and the opposite broad side of the first foam component 130 is adjacent one broad side of the third foam component 136. In other words, the first 130, second 138, and third 136 foam components are placed side by side to form three layers of a sandwich within the housing 102.

As further illustrated in the exploded view of FIG. 2, the first foam component 130 and the second foam component 138 comprise openings that pass through each respective foam component and define a circuitous air channel through which the intake air passes as it moves through the noise muffler 100 First foam component 130 comprises a first opening 132 with a cross-section having a partial oval shape and a second opening 134 with a cross-section having a bent oval shape. The second foam component 138 comprises a third opening 140 with a cross-section having an oval shape and a fourth opening 142 with a cross-section having a circular shape. The cross-sections described herein are cross-sections taken in a vertical plane parallel with the plane defined by the x-axis and y-axis shown in the figures. In the example noise muffler 100 of FIGS. 1 and 2, the third foam component 136 does not have any openings.

Referring to the path the intake air takes through the noise muffler 100, the intake air first enters the housing inlet 105, then enters the first opening 132 traveling downward and parallel with the y-axis. In the example of FIG. 2, the portion of the first opening 132 facing the housing inlet 105 forms a rectangular opening that is smaller in area than the opening provided by the housing inlet 105 thereby restricting the intake air as it enters the housing cavity where the foam components are located. Next, the intake air changes direction and flows in the direction of the z-axis and into the third opening 140 of the second foam component 138. The intake air continues in a downward direction parallel to the y-axis and then changes direction again and flows parallel to the z-axis but back towards the first foam component 130 and into the second opening 134 of the first foam component 130. At that point, the intake air can move in an upward diagonal direction along the second opening 134 and then change direction again in a direction parallel to the z-axis as the intake air moves into the fourth opening 142 of the second foam component 138. From the fourth opening 142, the intake air flows through the housing outlet 115 and into the appliance to which the noise muffler 100 is attached. The openings of the foam components force the intake air to make several changes in direction as it flows through the noise muffler 100. Similarly, noise from the air moving device will flow through the circuitous route within the noise muffler 100, but in a direction opposite to the intake air because the noise emanates from the air moving device. As the sound waves of the noise from the air moving device pass through the noise muffler 100 changing direction in a sequence opposite to that described for the intake air, the sound waves collide with the several surfaces of the foam components where they can be absorbed in order to mitigate the noise level.

Testing of the example noise muffler 100 of FIGS. 1 and 2 has illustrated the effectiveness of the noise muffler. The example test data provided below was gathered in testing of the noise muffler 100 with a water heater.

TABLE 1

| | Measured Noise (dB) |
|---|---|
| 1. Lab ambient noise | 79.2 |
| 2. No noise muffler | 113.4 |
| 3. Noise muffler with urethane foam | 93.5 |
| 4. Noise muffler with melamine foam | 93.1 |

In the first test shown in Table 1, the water heater was off and a sound meter placed next to the water heater measured lab ambient noise to be 79.2 dB. In the second test of Table 1, the water heater was operating with its air moving device (blower) operating and no noise muffler and the noise level was measured at 113.4 dB. In the third and fourth tests shown in Table 1, the example noise muffler was attached to the water heater as the water heater and blower were operating and the measured noise level was substantially reduced to 93.5 and 93.1 dB, respectively. In the third test listed in Table 1, the foam components of the noise muffler were made from urethane foam and in the fourth test listed in Table 1, the foam components of the noise muffler were made from melamine foam. In the course of other testing, other types of foam materials were tested, but the other types of foam material were less effective at absorbing sound than the urethane foam and melamine foam.

Optionally, a fourth foam component similar in shape to the third foam component 136 can be placed adjacent to the broad side of the second foam component 138 that is opposite to the side adjacent to the first foam component 130. When the fourth foam component forms a fourth layer with the first 130, second 138, and third 136 foam components within the noise muffler 100, the intake air passes through the air channel defined by the first opening 132, the third opening 140, the second opening 134, and the fourth opening 142 and the air channel is surrounded by the foam surfaces of the first 130, second 138, third 136, and fourth foam components. Surrounding the air channel with the foam surfaces of the foam components optimizes the absorption of noise by the foam as the sound waves of the noise pass through the noise muffler 100.

Figure 3:
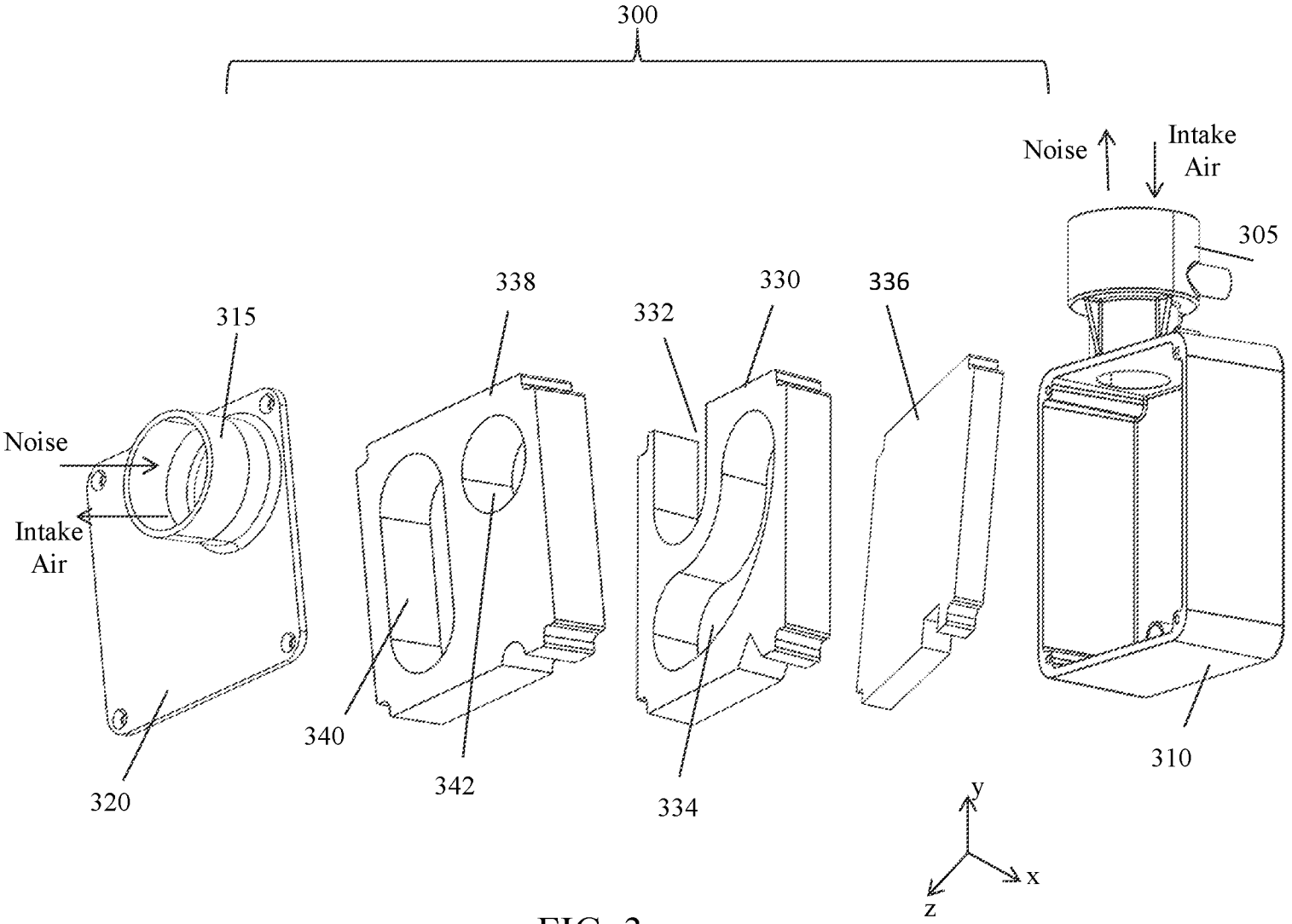
FIG. 3 illustrates an exploded view of another embodiment of a noise muffler for an air moving device in accordance with an example embodiment of the present disclosure.

Referring now to FIG. 3, an exploded view of another example noise muffler 300 is shown. Noise muffler 300 is similar to noise muffler 100 and analogous components between the two examples have the same last two digits in the three digit reference numbers. Noise muffler 300 comprises a housing 310 and a lid 320 which when joined form a cavity in which noise absorbing foam components are placed. The housing 310 has a housing inlet 305 through which intake air enters and muffled noise exits. The lid 320 has a housing outlet 315 through which intake air exits the noise muffler and enters the appliance. The housing outlet 315 also receives, from the appliance to which it is attached, sound waves from noise emanating from the air moving device of the appliance and those sound waves are muffled as they enter the cavity of the housing 310 and encounter the foam components. The foam components and their arrangement in example noise muffler 300 is similar to that described in connection with noise muffler 100 of FIGS. 1 and 2. The foam components of example noise muffler 300 comprise first foam component 330, a second foam component 338, and a third foam component 336. The first foam component 330 comprises a first opening 332 with a cross-section having a partial oval shape and a second opening 334 with a cross-section having a bent oval shape. The second foam component 338 comprises a third opening 340 with a cross-section having an oval shape and a fourth opening 342 with a cross-section having a circular shape. As explained above, the cross-sections described herein are cross-sections taken in a vertical plane parallel with the plane defined by the x-axis and y-axis shown in the figures, in the example noise muffler 300 of FIG. 3, the third foam component 336 does not have any openings. The direction of flow of the intake air and noise through the air channel defined by the openings of the foam components in noise muffler 300 is the same as that described previously in connection with the example of FIGS. 1 and 2 and will not be repeated.

Figure 4:
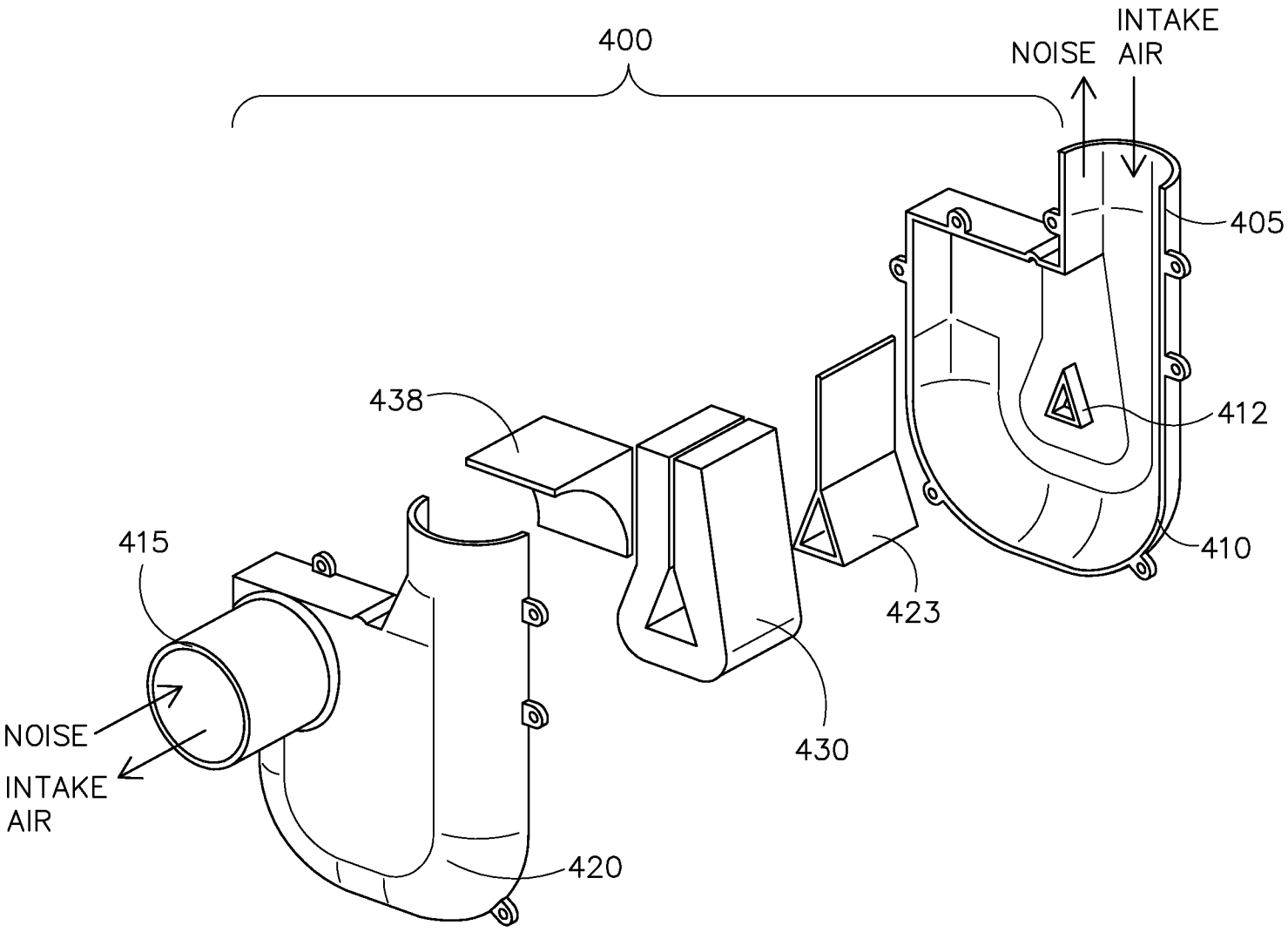
FIG. 4 illustrates an exploded view of another embodiment of a noise muffler for an air moving device in accordance with an example embodiment of the present disclosure.
Figure 5:
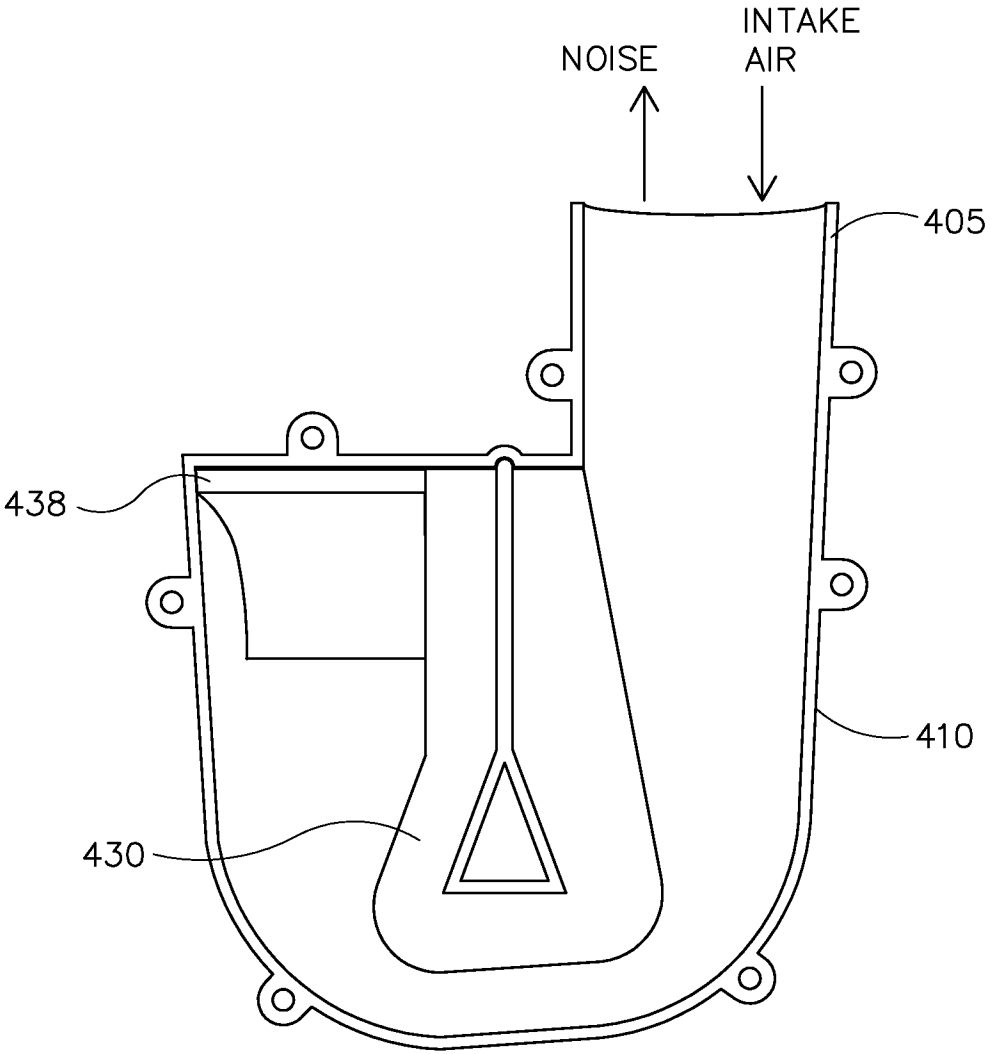
FIG. 5 illustrates a portion of the noise muffler of FIG. 4 in accordance with an example embodiment of the present disclosure.

Referring now to FIGS. 4 and 5, views of another example noise muffler 400 are provided. FIG. 4 illustrates an exploded view of the example noise muffler 400. The example noise muffler 400 has a housing that comprises a front housing portion 420 and a back housing portion 410. The perimeter of the front housing portion 420 and back housing portion 410 comprise protruding bosses which can be fastened together by inserting fasteners through the protruding bosses. In alternate embodiments, the front housing portion 420 and back housing portion 410 can be joined with other types of fasteners or coupling mechanisms. The housing further comprises a housing inlet 405 and a housing outlet 415. The housing outlet 415 can be attached to an appliance comprising an air moving device. Typically, the appliance has an intake port through which air is drawn into the appliance by the air moving device and the housing outlet 415 of the noise muffler 400 can be attached to the intake port of the appliance. On the top side of the housing, the housing inlet 405 can be attached to a venting tube, such as a standard 2 inch PVC venting tube. As illustrated by the arrows in FIG. 4, the air moving device of the appliance draws intake air first through the housing inlet 405, then through the cavity defined within the housing, and then through the housing outlet 415, where the intake air then enters the appliance.

As further illustrated by the arrows in FIGS. 4 and 5, noise emanates from the air moving device of the appliance. When the noise muffler 400 is attached to the appliance, the noise emanating from the air moving device follows a path opposite to the intake air. In other words, noise from the air moving device first passes into the housing outlet 415, then through the housing, and then through the housing inlet 405. However, the features within the noise muffler 400 absorb a substantial portion of the noise thereby reducing the noise that passes into the environment surrounding the appliance to which the noise muffler is attached.

Example noise muffler 400 further comprises a first foam component 430 and a second foam component 438. The back housing portion 410 comprises a mounting feature 412 on the inner wall of the back housing portion 410. A mounting 423 slides onto the mounting feature 412. In the example shown in FIGS. 4 and 5, the mounting feature 412 has a protruding triangular shape and the mounting 423 comprises a triangular shaped aperture so that the triangular shaped aperture of the mounting 423 slides onto the protruding triangular shape of the mounting feature 412. The mounting 423 also comprises an upper flange. The first foam component 430 has a U shape which allows the first foam component 430 to slide onto the mounting 423. The second foam component 438 has a wedge shape with a curved surface. The second foam component 438 is positioned between the first foam component 430 and a side wall of the housing. FIG. 5 shows the back housing portion 410 with the first foam component 430 and the second foam component 438 positioned within the back housing portion 410.

The foam components 430 and 438 of noise muffler 400 are arranged to minimize a drop in pressure as the intake air passes through the noise muffler 400. As illustrated in FIGS. 4 and 5, intake air enters the housing inlet 405 and proceeds in a downward direction parallel with the y-axis. At the bottom of the noise muffler 400, the intake air makes a perpendicular turn and proceeds along the bottom of the noise muffler 400 below the first foam component 430 in a direction parallel to the x-axis. As the intake air encounters the side wall of the housing it makes another perpendicular turn and proceeds in an upward direction towards the second foam component 438 and parallel to the y-axis. Lastly, when the intake air encounters the curved surface of the second foam component 438, the intake air makes another perpendicular turn in a direction parallel with the 2-axis and flows out of the housing outlet 415. As such, the first foam component 430 and second foam component 438 define an air channel within the cavity of the housing so that the intake air flows around the U-shaped first foam component 430 and then is redirected by the wedge shape of the second foam component 438 to exit from the housing outlet 415. As illustrated by the arrows in FIGS. 4 and 5, the sound waves of the noise emanating from the appliance to which the noise muffler 400 is attached proceed through the noise muffler 400 in a direction opposite to that of the intake air.

Testing of the example noise muffler 400 of FIGS. 4 and 5 has illustrated the effectiveness of the noise muffler. The example test data provided below was gathered in testing of the noise muffler 400 with a water heater.

TABLE 2

| | Measured Noise (dB) |
|---|---|
| 1. Lab ambient noise | 77.6 |
| 2. No noise muffler | 114 |
| 3. Noise muffler 400 | 101 |

In the first test shown in Table 2, the water heater was off and a sound meter placed next to the water heater measured lab ambient noise to be 77.6 dB. In the second test of Table 2, the water heater was operating with its air moving device (blower) operating and no noise muffler and the noise level was measured at 114 dB. In the third test shown in Table 2, the example noise muffler 400 described in connection with FIGS. 4 and 5 was attached to the water heater as the water heater and blower were operating and the measured noise level was substantially reduced to 101 dB. The results of the testing shown in Table 2 are similar the results of the testing shown in Table 1 and demonstrate the effectiveness of the example noise mufflers described herein.

The components of the foregoing example embodiments can be pre-fabricated or specifically generated (e.g., by shaping a malleable body) for a particular appliance and/or environment. The components of the example embodiments described herein can have standard or customized features (e.g., shape, size, features on the inner or outer surfaces). Therefore, the example embodiments described herein should not be considered limited to creation or assembly at any particular location and/or by any particular person.

The noise muffler and the components therein can be made of one or more of a number of suitable materials and/or can be configured in any of a number of ways to allow the appliance to which it is attached to meet certain standards and/or regulations while also maintaining reliability of the appliance, regardless of the one or more conditions under which the appliance can be exposed. Examples of such materials can include, but are not limited to, aluminum, steel, fiberglass, plastic, and various types of foams, for example.

The example components of the noise mufflers described herein can be made from a single piece (e.g., as from a mold, injection mold, die cast, 3-D printing process, extrusion process, stamping process, crimping process, and/or other prototype methods). In addition, or in the alternative, the example components of the noise mufflers described herein can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As used herein, a "coupling feature" can couple, secure, fasten, abut, and/or perform other functions aside from merely coupling. A coupling feature as described herein can allow one or more components of an example noise muffler to become coupled, directly or indirectly, to another portion (e.g., an inner surface) of the noise muffler. A coupling feature can include, but is not limited to, a snap, a clamp, a portion of a hinge, an aperture, a recessed area, a protrusion, a slot, a spring clip, a tab, a detent, a compression fitting, and mating threads. One portion of an example noise muffler can be coupled to a component of a noise muffler and/or another portion of the noise muffler by the direct use of one or more coupling features.

In addition, or in the alternative, a portion of an example noise muffler can be coupled to another component of a noise muffler and/or another portion of the noise muffler using one or more independent devices that interact with one or more coupling features disposed on a component of the noise muffler. Examples of such devices can include, but are not limited to, a weld, a pin, a hinge, a fastening device (e.g., a bolt, a screw, a rivet), epoxy, adhesive, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. For any figure shown and described herein, one or more of the components may be omitted, added, repeated, and/or substituted. Accordingly, embodiments shown in a particular figure should not be considered limited to the specific arrangements of components shown in such figure.

Appliances to which an example noise muffler may be attached can be subject to complying with one or more of a number of standards, codes, regulations, and/or other requirements established and maintained by one or more entities Examples of such entities can include, but are not limited to, the American Society of Mechanical Engineers (ASME), American National Standards Institute (ANSI), Canadian Standards Association (CSA), the Tubular Exchanger Manufacturers Association (TEMA), the American Society of Heating, Refrigeration and Air Conditioning Engineers (ASHRAE), Underwriters' Laboratories (UL), the National Electric Code (NEC), the Institute of Electrical and Electronics Engineers (IEEE), and the National Fire Protection Association (NFPA). The example noise mufflers described herein allow the appliance to which is attached to continue complying with such standards, codes, regulations, and/or other requirements. In other words, the example noise mufflers described herein do not compromise compliance with any applicable codes and/or standards.

Terms such as "first," "second," "top," "bottom," "left," "right," "end," "back," "front," "side", "length," "width," "inner," "outer," "above", "lower", and "upper" are used merely to distinguish one component (or part of a component or state of a component) from another. Such terms are not meant to denote a preference or a particular orientation unless specified and are not meant to limit embodiments of the noise mufflers described herein. In the foregoing detailed description of the example embodiments, numerous specific details are set forth in order to provide a more thorough understanding of the disclosure. However, it will be apparent to one of ordinary skill in the art that the example embodiments may be practiced without these specific details. In other instances, well-known features have not been described in detail to avoid unnecessarily complicating the description.

Accordingly, many modifications and other embodiments set forth herein will come to mind to one skilled in the art having the benefit of the teachings presented in the foregoing descriptions and the associated drawings. Therefore, it is to be understood that example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A water heater comprising:
a blower comprising a gas inlet and an air inlet; and
a noise muffler comprising:
an air intake portion;
an air outlet portion;
a first foam component; and
a second foam component disposed adjacent to the first foam component, wherein the first foam component and the second foam component together are configured to direct air through the noise muffler in three dimensions;
wherein air enters the noise muffler via the air intake portion, and noise exits the noise muffler via the air intake portion; and
wherein the air exits the noise muffler via the air outlet portion, and the noise enters the noise muffler via the air outlet portion.

2. The water heater of claim 1, wherein the air inlet is disposed on a first side of the blower and the gas inlet is disposed on a second side of the blower.

3. The water heater of claim 2, wherein the noise muffler is coupled to the first side of the blower.

4. The water heater of claim 3, wherein the gas inlet is aligned with a lateral axis of the water heater, and the noise muffler is oriented such that the air intake portion is aligned with a vertical axis of the water heater; and
wherein the lateral axis and the vertical axis are perpendicular.

5. The water heater of claim 1, wherein a first central axis of the air intake portion is perpendicular to a second central axis of the air outlet portion.

6. The water heater of claim 1, wherein the noise muffler comprises a rectangular housing having a rectangular sidewall, and wherein the air outlet portion is disposed adjacent to a corner of the rectangular sidewall.

7. The water heater of claim 6, wherein the rectangular housing has a rectangular upper surface, and wherein the air intake portion is disposed in an offset position adjacent to a side of the rectangular upper surface.

8. The water heater of claim 1, wherein the noise muffler further comprises a pressure port coupled to the air intake portion.

9. The water heater of claim 1, wherein the first foam component has a first aperture and the second foam component has a second aperture, and wherein the second foam component is positioned such that the second aperture partially overlaps the first aperture.

10. The water heater of claim 1, wherein the blower is disposed on a bottom surface of the water heater.

11. The water heater of claim 1, wherein an entirety of an air flow path through the first foam component and the second foam component is surrounded by foam material.

12. A noise muffler comprising:
an air intake portion;
an air outlet portion;
a first foam component; and
a second foam component disposed adjacent to the first foam component, wherein the first foam component and the second foam component together are configured to direct air through the noise muffler in three dimensions;
wherein air enters the noise muffler via the air intake portion, and noise exits the noise muffler via the air intake portion; and
wherein the air exits the noise muffler via the air outlet portion, and the noise enters the noise muffler via the air outlet portion.

13. The noise muffler of claim 12, wherein a first central axis of the air intake portion is perpendicular to a second central axis of the air outlet portion.

14. The noise muffler of claim 12, further comprising:
a rectangular housing having a rectangular sidewall, and wherein the air outlet portion is disposed adjacent to a corner of the rectangular sidewall.

15. The noise muffler of claim 14, wherein the rectangular housing has a rectangular upper surface, and wherein the air intake portion is disposed in an offset position adjacent to a side of the rectangular upper surface.

16. The noise muffler of claim 12, further comprising:
a pressure port coupled to the air intake portion.

17. The noise muffler of claim 12, wherein the first foam component has a first aperture and the second foam component has a second aperture, and wherein the second foam component is positioned such that the second aperture partially overlaps the first aperture.

18. The noise muffler of claim 12, wherein an entirety of an air flow path through the first foam component and the second foam component is surrounded by foam material.

19. The noise muffler of claim 12, wherein the noise muffler is configured to be coupled to a blower of a water heater.

20. A water heater comprising:
a blower comprising a gas inlet and an air inlet; and
a noise muffler comprising:
a rectangular housing;
an air intake portion extending from a top surface of the rectangular housing;
an air outlet portion disposed on a side surface of the rectangular housing;
a first foam component disposed in the rectangular housing; and
a second foam component disposed adjacent to the first foam component in the rectangular housing, wherein the first foam component and the second foam component together are configured to direct air through the noise muffler in three dimensions;
wherein air enters the noise muffler via the air intake portion, and noise exits the noise muffler via the air intake portion; and
wherein the air exits the noise muffler via the air outlet portion, and the noise enters the noise muffler via the air outlet portion.

* * * * *